US011293192B2

(12) United States Patent
Vitale, Jr.

(10) Patent No.: US 11,293,192 B2
(45) Date of Patent: Apr. 5, 2022

(54) ADJUSTABLE CONCRETE REINFORCEMENT HANGER ASSEMBLY

(71) Applicant: Michael J. Vitale, Jr., Auburn, NY (US)

(72) Inventor: Michael J. Vitale, Jr., Auburn, NY (US)

( * ) Notice: Subject to any disclaimer, the term of this patent is extended or adjusted under 35 U.S.C. 154(b) by 0 days.

(21) Appl. No.: 17/092,938

(22) Filed: Nov. 9, 2020

(65) Prior Publication Data

US 2021/0115685 A1 Apr. 22, 2021

Related U.S. Application Data

(62) Division of application No. 16/454,291, filed on Jun. 27, 2019, now abandoned.

(51) Int. Cl.

| | |
|---|---|
| ***E04B 1/38*** | (2006.01) |
| ***E04G 21/18*** | (2006.01) |
| ***E04G 17/12*** | (2006.01) |
| ***E04C 5/16*** | (2006.01) |

(52) U.S. Cl.
CPC ..... *E04G 21/185* (2013.01); *E04C 5/163* (2013.01); *E04G 17/12* (2013.01)

(58) Field of Classification Search
CPC ..... E04G 21/185; E04G 17/12; E04C 5/163; E04C 5/205; E04C 5/201; E04C 5/206; E04C 5/168
USPC ..... 52/699
See application file for complete search history.

(56) References Cited

U.S. PATENT DOCUMENTS

| | | | | |
|---|---|---|---|---|
| 3,530,634 | A | 9/1970 | Adams | |
| 3,863,886 | A | 2/1975 | Carr | |
| 4,029,288 | A | 6/1977 | Murphy | E04G 13/00 249/216 |
| 5,060,892 | A | 10/1991 | Dougherty | |
| 6,494,642 | B1 | 12/2002 | Daly | |
| 6,591,574 | B2 | 7/2003 | Humphrey | E04G 13/00 248/200.1 |
| 7,182,309 | B1 | 2/2007 | Olsen | E01C 19/56 249/2 |
| 7,243,897 | B2 | 7/2007 | Huber et al. | |
| 7,275,731 | B1 | 10/2007 | Shinault | |
| 7,444,789 | B1 | 11/2008 | Moore | |
| 7,467,777 | B2 | 12/2008 | Huber et al. | |
| 7,841,576 | B2 | 11/2010 | Miller | E04G 17/12 249/8 |
| 7,959,125 | B1 | 6/2011 | Coleman | |

(Continued)

*Primary Examiner* — Basil S Katcheves
(74) *Attorney, Agent, or Firm* — Barclay Damon LLP

(57) ABSTRACT

An adjustable concrete reinforcement assembly includes a base member having a pair of open ends and an upper axial cavity defined along the length of the base member. A pair of frame members each include a horizontal extending portion and a vertical extending portion in which the horizontal extending portions are sized to engage the upper axial cavity of the base member. A hanger member is disposed at an upper end of the vertical extending portions of each frame member; wherein the frame members are axially movable within the base member to enable a horizontal dimension of the assembly to be selectively adjusted. At least one support is further provided to receive at least one concrete reinforcement member, such as rebar. In at least one version, adjustments can be to the horizontal dimension of the frame and optionally the vertical and horizontal positioning of the hanger members relative to a concrete form.

14 Claims, 17 Drawing Sheets

(56) References Cited

U.S. PATENT DOCUMENTS

| | | | | |
|---|---|---|---|---|
| 8,231,100 | B2 | 7/2012 | Boese | E04B 1/16 249/216 |
| D714,628 | S | 10/2014 | Vitale, Jr. | D8/384 |
| 10,106,993 | B2 | 10/2018 | Harrison | E01C 19/502 |
| 10,214,925 | B2 | 2/2019 | Hartman | |
| 10,570,632 | B1 | 2/2020 | Hartman | E04G 17/14 |
| 2006/0188336 | A1 | 8/2006 | Huber | E04G 17/12 404/136 |
| 2006/0260239 | A1 | 11/2006 | Boese | E04G 17/14 52/426 |
| 2018/0127992 | A1 | 5/2018 | Hartman | |

ADJUSTABLE CONCRETE REINFORCEMENT HANGER ASSEMBLY

CROSS REFERENCE TO RELATED APPLICATION

This application is a divisional application of U.S. Ser. No. 16/454,291, filed Jun. 27, 2019 claiming priority under 35 U.S.C. § 120, in which the priority application is incorporated by reference in its entirety.

The application relates generally to the field of foundation casting and more specifically to a reinforcement hanger for adjustably securing reinforcing bars within the confines of a concrete form.

BACKGROUND

In the field of construction, it is common practice to cast a foundation or structural base with concrete. A trench is prepared into which the forms, typically made from steel, wood or other material such as plastic, are set up adjacent and connected to each other and matching the dimensions of the required foundation (footing). The forms, which include steel panels, wooden boards or planks or suitably sized plastic components, are put into position on their edges across from each other and parallel to each other near the side walls of the trench.

Steel reinforcement of the footing generally takes the form of reinforcing bars, such as rebar, that are placed in the form in such a way that the wet concrete completely covers the reinforcing bars. To that end, concrete chairs or bricks or reinforcement hangers are generally known for placement between portions of forms in order to support or suspend the rebar and/or other reinforcement members. There are known reinforcement hangers made from a unitary metallic or plastic section that are specifically and fixedly dimensioned for placement within specific predetermined configurations. For reasons relating to current manufacture and design, frequent changes in commercial and residential needs and providing an adequate stock and inventory, among others, there is a general need in the field to provide a concrete reinforcement hanger that enables adjustability in order to account for different and varied concrete form applications.

BRIEF DESCRIPTION

According to a first aspect, there is provided an adjustable concrete reinforcement assembly that includes a base member having a pair of open ends and an upper axial cavity defined along the length of the base member. A pair of frame members each include a horizontal extending portion and a vertical extending portion, in which the horizontal extending portions are each sized to engage the upper axial cavity of the base member. A hanger member is disposed at an upper end of the vertical extending portions of each frame member, wherein the frame members are axially movable within the base member to enable a horizontal dimension of the assembly to be selectively adjusted. At least one reinforcement support is further provided on the frame members or the base member, the at least one reinforcement support being sized and configured to receive at least one concrete reinforcement member, such as section of rebar. In at least one version, adjustments can be to the horizontal dimension of the frame. In another version, adjustments can be made the horizontal dimension of the assembly as well as the vertical positioning of the hanger members.

In one embodiment, the horizontal extending portions of each frame member and the base member include a plurality of axially spaced engagement features to enable the assembly to assume a plurality of predetermined horizontal positions. According to one version, one of the horizontal extending portions or the base member include a plurality of axially spaced locking tabs and the other of the horizontal extending portions or the base member include a plurality of axially spaced openings sized to receive a locking tab. Alternatively or in combination, one of the horizontal extending portions or the base member can include a plurality of axially spaced vertical protrusions and the other of the horizontal extending portions or the base member include a plurality of axially spaced notches sized to engage any of the vertical protrusions to define the plurality of predetermined horizontal positions.

As noted and in at least one version, at least one of the base member or the pair of frame members include at least one reinforcement support. For example, each frame member can include a corner brace having an angled surface between the vertically extending portion and horizontal extending portion, wherein at least one reinforcement support is disposed on the angled surface. In another version or in combination, at least one reinforcement support extends upwardly from an upper surface of the base member. For example, a reinforcement support can be disposed at substantially the center of the base member.

Preferably, the assembly including the base member, hanger members and the pair of frame members are made from a moldable plastic.

According to another aspect, there is provided an adjustable concrete reinforcement assembly comprising a frame including a first frame member and a second frame member. Each of the first and second frame members are defined by a horizontal extending portion and a vertical extending portion defining a substantial L-shape. A hanger member extends from the upper end of the vertical extending portions of each of the first and second frame members, each hanger member being shaped and configured to engage a top part of a concrete form. The assembly further includes at least one concrete reinforcement support, wherein at least one of a horizontal dimension of the frame or the vertical position of the hanger members is selectively adjustable.

In at least one embodiment, the horizontal extending portion of the first frame member is adjustably fitted within an elongated axial cavity defined in the horizontal extending portion of the second frame member, enabling the horizontal dimension of the frame to be selectively adjusted based on the size of the concrete form. In another version, each of the first and second frame members can be fitted within an axial slot or cavity provided in the top of a base member. In at least one version, the horizontal extending portion of one of the first and second frame members comprises a plurality of vertically disposed slots and the horizontal extending portion of the other of the first and second frame members comprises at least one engagement feature sized for engaging any of the plurality of vertically disposed slots to define a plurality of predetermined horizontal positions. In another version, the base member and the first and second frame members include complementary engagement features for defining a plurality of predetermined horizontal positions.

According to one version, the base member and/or first and second frame members can include a plurality of demarcations for indicating a horizontal dimension based on the position of the at least one engagement feature relative to the plurality of vertically disposed slots.

In at least one version, the assembly can include at least one intermediary linking member attachable to the horizontal extending portions of the first and second frame members. In one version, the intermediary linking member is the base member with the axial cavity sized to receive the horizontal extending portions of the first and second frame members. According to another version, the at least one intermediary linking member is attachable to the mated first and second frame members.

According to at least one version, the first and second frame members can include an angled corner brace wherein at least one concrete reinforcement support can be disposed directly on the brace. In at least one embodiment, at least one of said intermediary linking member or the first and second frame members can include at least one concrete reinforcement support.

In at least one embodiment, the vertical extending portions of the first and second frame members each include a plurality of spaced slots disposed along at least a portion of the length thereof, the hanger members each including at least one through opening and a flexible member having an engagement feature extending into the at least one opening and configured for engaging a spaced slot of a vertical extending portion. In one version, the hanger members each include an upper transverse portion and a downwardly depending portion at an outer end and in which the vertically extending portion, upper transverse portion and downwardly depending portion combine to define a spacing, the hanger members including at least one feature for varying the spacing. The hanger members can each include a plurality of spaced openings and a flexible member disposed in relation to each opening, the flexible member having an engagement feature extending into said opening and engageable with a slot in the vertically extending portions. The hanger portions can also include an engagement member in relation to each of the openings used in conjunction with a series of slots defined on the vertical extending portion of the frame to selectively adjust the height of the assembly depending, for example, on the depth of the form or footing.

According to another aspect, there is provided a method of fabricating an adjustable concrete reinforcement assembly. The method comprising the steps of providing a frame including a pair of frame members, each of the frame members including a horizontal extending portion and a vertical extending portion. Hanger members are provided, each extending transversely from the vertical extending portion of the pair of frame members, the hanger members being configured to engage a top part of a concrete form. Engagement features are additionally provided to permit at least one of a horizontal dimension of the frame or the vertical position of the hanger members to be selectively adjusted.

In at least one version, the method further comprises the additional steps of providing a base member with an upper axial cavity and open ends, fitting the horizontal extending portions of each of the pair of frame members within the upper axial cavity, and providing the engagement features in the base member and the pair of frame members to enable the assembly to selectively assume a plurality of predetermined horizontal positions.

According to at least one embodiment, the method further comprises providing one of the horizontal extending portions or the base member with a plurality of axially spaced locking tabs and the other of the horizontal extending portions or the base member with a plurality of axially spaced openings, each opening being sized to receive a locking tab. Alternatively or in combination, the method can include providing one of the horizontal extending portions or the base member with a plurality of axially spaced vertical protrusions and the other of the horizontal extending portions or the base member with a plurality of axially spaced notches sized to engage any of the vertical protrusions to define the plurality of predetermined horizontal positions. According to at least one version, markings can be provided on the assembly (base member, frame members) in order to designate a plurality of incremental horizontal positions.

According to another version, the horizontal extending portion of one of the pair of frame members can include an elongated axial enclosure sized for receiving the horizontal extending portion of the other frame member and further including at least one feature for fixing the horizontal dimension. In at least one embodiment, at least one of the horizontal extending portions can be provided with a plurality of axially disposed vertical slots and the other of the horizontal extending portions with at least one flexible engagement member configured for engaging the plurality of vertical slots for adjusting a horizontal dimension of the frame.

In at least one version, at least one intermediary linking member can be provided for maintaining the desired horizontal position of the mated horizontal extending portions.

The method can include providing each of the hanger members with spaced openings in a transverse upper portion thereof and a flexible member disposed in relation to each opening. Each opening is sized to be fitted within the vertically extending portion of each frame member in order to vary the spacing between the vertically extending portion and the downwardly depending portion of the attached hanger member. In at least one embodiment, the flexible member can include at least one feature for engaging a slot in the vertically extending portion for selectively varying the height of the hanger portions relative to the remainder of the frame.

An advantage provided is that a single concrete reinforcement assembly, as described herein, can be used in conjunction with different sized forms and/or footings having varying widths and applications. Adjustments to the hanger assembly can be made in the field based on the dimensions of the concrete form, as well as other adjustments dependent on the size of the form.

Another advantage provided is that the increased versatility provided solves inventory problems in which sets of different sized assemblies previously had to be kept in stock. That is, a single adjustable reinforcement assembly can now be provided that is useful in a plurality of different applications, including residential and commercial.

Still further, the herein described concrete reinforcement assembly can be molded from a lightweight moldable plastic material that reduces costs in terms of manufacture and affordability. This material can preferably be made from a green material, such as plastic resins, enabling recycling of the assembly following use. In addition, the herein described assembly is simple to use without significant amounts of training, while being at least as reliable as prior hanger assemblies.

These and other advantages and features will be readily apparent from the following Detailed Description, which should be read in conjunction with the accompanying drawings.

BRIEF DESCRIPTION OF THE DRAWINGS

FIG. 3(*b*) is a rear perspective view of the first frame member of FIG. 3(*a*);

FIG. 4(*b*) is a rear perspective view of the second frame member of FIG. 4(*a*);

FIG. 5(*b*) is a front perspective view of the intermediary linking member of FIG. 5(*a*) with an attached reinforcement support in accordance to one version;

FIG. 6(*b*) is a top plan view of the hanger member of FIG. 6(*a*);

DETAILED DESCRIPTION

The following description relates to a number of embodiments of a reinforcement hanger assembly adapted for hanging placement in different sized concrete forms. Throughout the course of discussion, several terms such as "upper", "lower", "top", "bottom", "lateral", "horizontal", "vertical" and the like are often used in order to provide a suitable frame of reference with regard to the accompanying drawings. These terms should not be regarded as limiting in terms of the scope of the described invention, except where so specifically indicated. In addition, it should further be noted that the drawings are not necessarily to scale and should be relied upon solely for depicting the salient features of the present invention.

Figure 1:
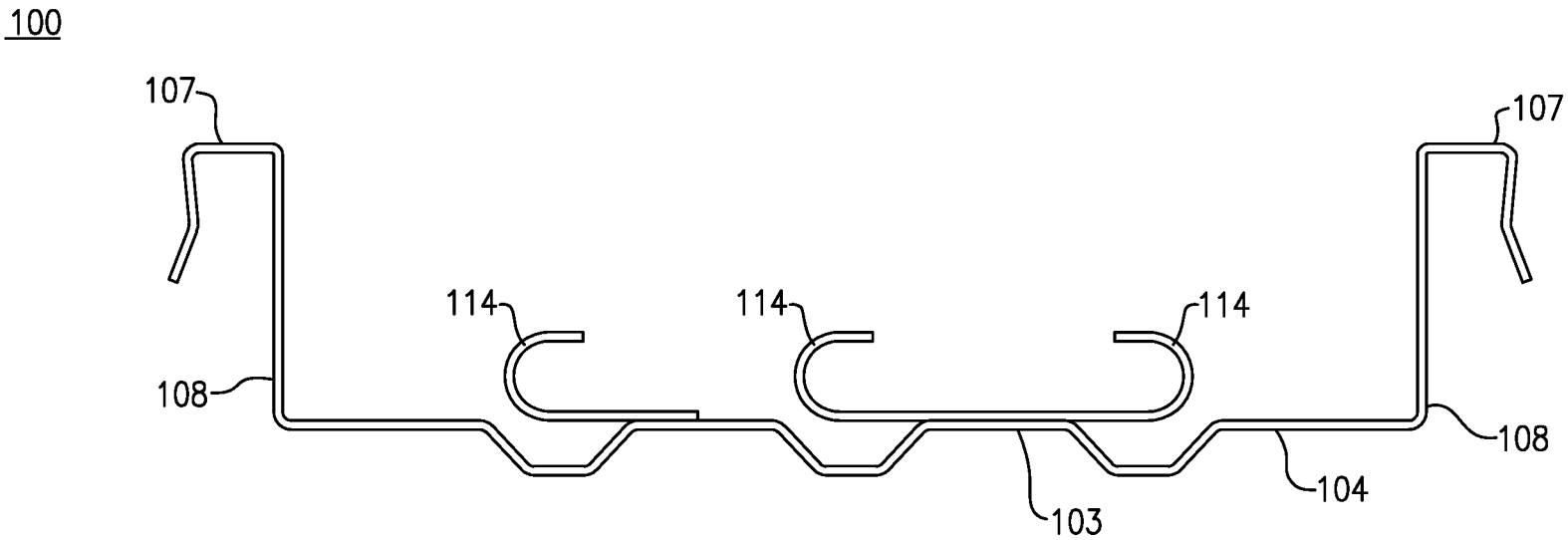
FIG.1 Prior Art
FIG. 1 is a perspective view of a known concrete reinforcement assembly in accordance with the prior art.

For purposes of background, a previously known concrete reinforcement assembly 100, is shown in FIG. 1. More specifically, this assembly 100 is commercially manufactured and sold by Vitale Ready-Mix Concrete, Inc. and Robinson Concrete, Inc. of Auburn, N.Y., and is defined by a unitary section 104 that is made from a substantially rigid metallic material, such as brass or steel, or other structural material. Typically, a rod-like section of the rigid material is integrally formed into a horizontal portion 103 and a pair of hanger portions 107. Each hanger portion 107 is disposed on opposing ends 108 of the horizontal portion 103 and formed in a configuration substantially having an inverted U-shape, each hanger portion 107 being sized for fitting over the top of a wall of a form (not shown), with the horizontal portion 103 spanning the width of the form between the walls thereof.

A set of reinforcement retainer sections 114 are further defined along the span of the horizontal portion 103. Each reinforcement retainer section 114 is commonly defined by a reverse C or hook-shaped member configured and shaped for retaining at least one section of rebar or other reinforcement material. This known reinforcement assembly 100, including the span of the horizontal portion 103 and the hanger portions 107, is completely fixed in terms of its configuration and therefore incapable of any type of adjustment. That is and in order to provide reinforcement for a differently sized concrete footing, a separate reinforcement assembly configured for the size of the footing must therefore be made available.

Figure 2:
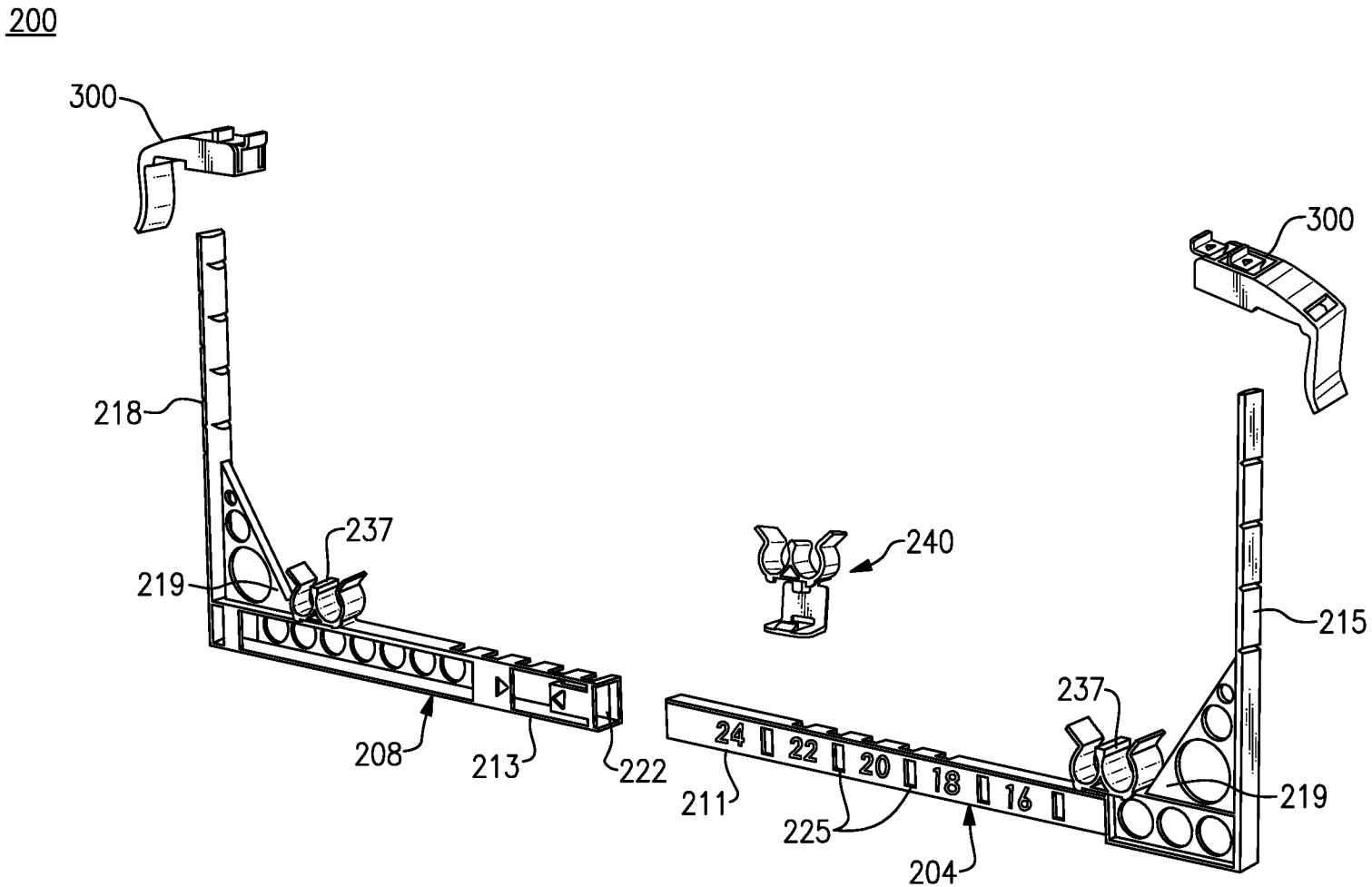
FIG. 2 is an exploded assembly view of a concrete reinforcement assembly in accordance with a first embodiment.

Referring to FIG. 2, an adjustable concrete reinforcement assembly 200 in accordance with an exemplary embodiment, and shown in exploded form, includes a frame which can be made from a pair of frame members; namely, respective first and second frame members 204, 208. The first frame member 204 is defined by a horizontal extending portion 211 and a vertical extending portion 215, while the second frame member 208 is similarly defined by a horizontal extending portion 213 and a corresponding vertically extending portion 218. Each of the first and second frame members 204, 208 according to this specific embodiment are defined by a substantially L-shaped configuration and are made from a moldable plastic, such as polyethylene. It will be readily apparent from this description, however, that other suitable materials could be utilized. Corner braces 219 are formed between a proximal end of the horizontal extending portion 211, 213 and the lower end of the vertically extending portion 215, 218 of the first and second frame members 204, 208 to provide additional structural stability and strength to the herein described assembly 200.

As discussed herein, the horizontal extending portions 211, 213 are releasably matable with one another to enable the horizontal dimension of the reinforcement assembly 200 to be selectively adjusted, depending on the distance between walls of a concrete form (not shown). According to this specific embodiment, at least one intermediate linking member 240 is couplable to the mated horizontal extending portions 211, 213 and configured for maintaining the selected horizontal dimension of the assembly 200.

Hanger portions 300 are releasably attached to the vertically extending portions 215, 218 and more specifically to upper ends thereof, each of the hanger portions 300 being sized and shaped to fit over the top of the walls (not shown) of the form (not shown). The vertical position of the hanger portions 300 and/or the span (i.e., width) of each hanger portion 300 can also be selectively adjusted by a user, as discussed herein.

Figure 3A:
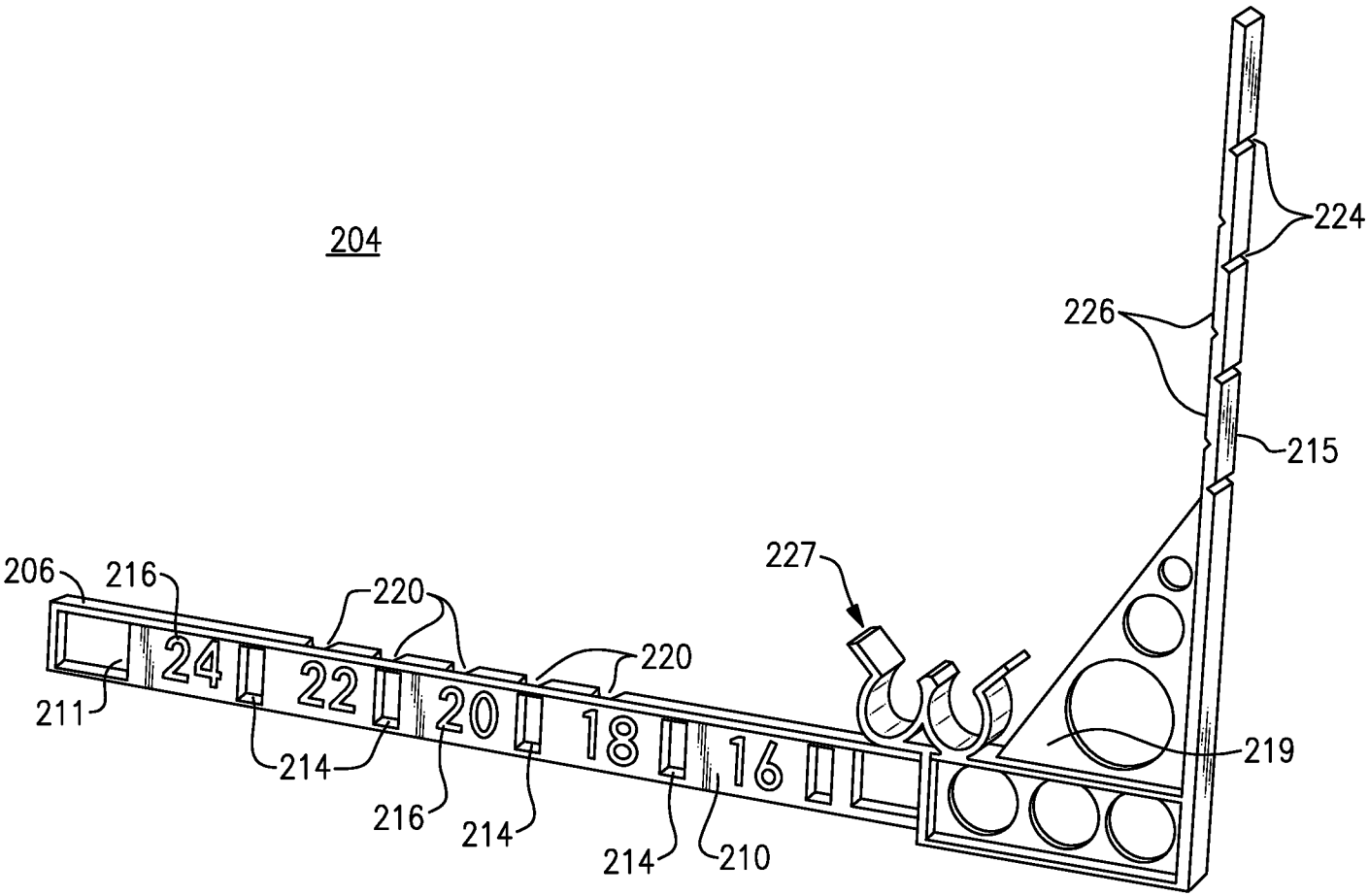
FIG. 3(*a*) is a front perspective view of a first frame member of the concrete reinforcement assembly of FIG. 2.
Figure 3B:
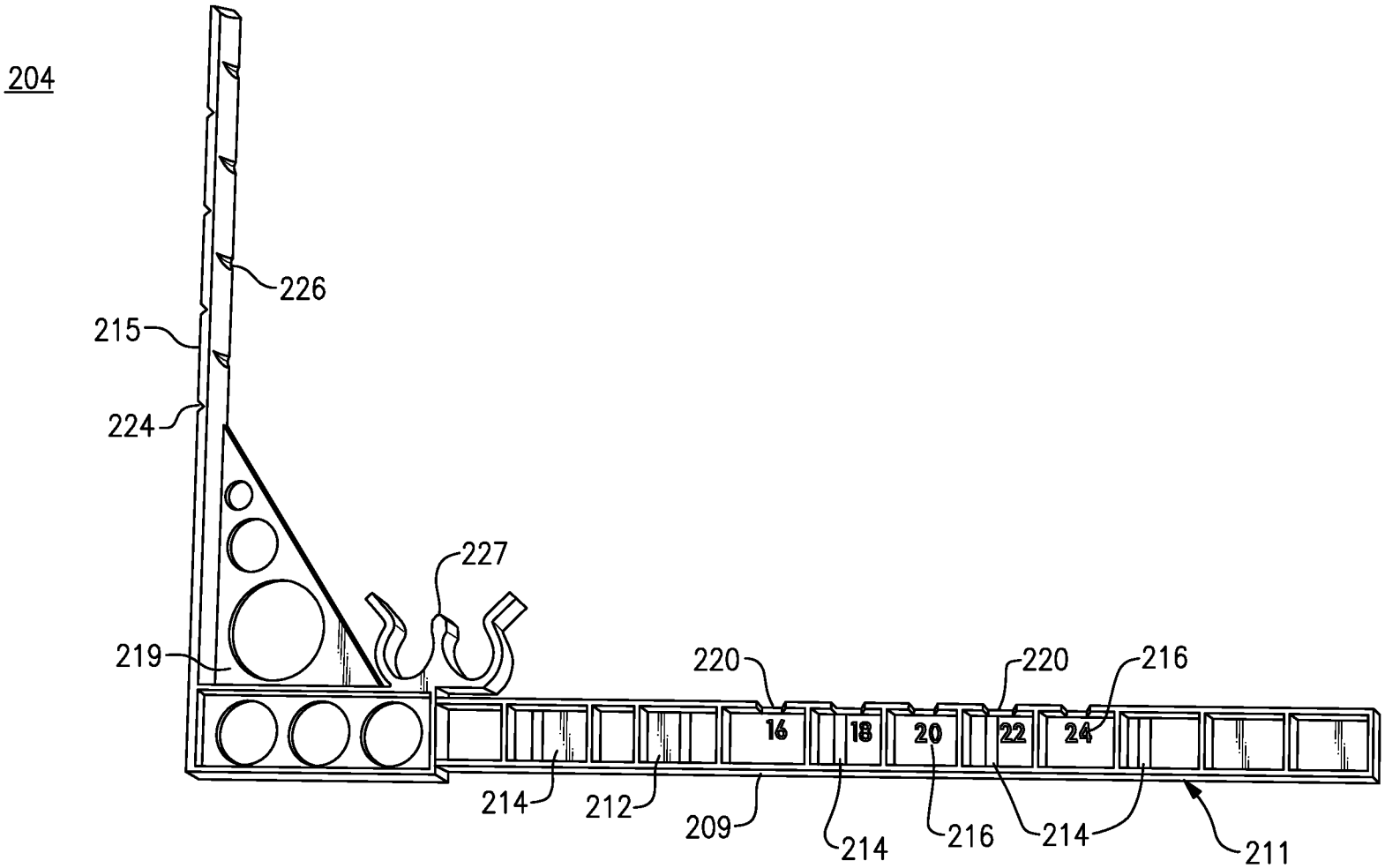

Details relating to each of the components of the depicted reinforcement assembly 200 are now provided. Referring first to FIGS. 3(*a*) and 3(*b*) and as previously noted, the first frame member 204 is defined by the horizontal extending portion 211 and the vertical extending portion 215, which combine to define a substantially L-shaped configuration and further include the corner brace 219. More specifically, the horizontal extending portion 211 is defined by a substantially rectangular configuration that includes respective upper and lower sides or surfaces 206, 209 and front and rear facing lateral sides or surfaces 210, 212 disposed therebetween. According to this exemplary embodiment and as shown, portions of the material comprising the rear facing side 212, as well as the corner brace 219 can be removed in order to reduce the weight of the first frame member 204. In a plastic version of this assembly, for example, these material portions can be removed initially as part of the molding process as well as for better enabling the assembly to be embedded within the concrete form.

As shown in FIG. 3(*a*), a series of axially spaced vertical slots 214 are provided along the front facing side 210 of the horizontal extending portion 211. A total of five (5) axially spaced slots 214 are provided according to this specific embodiment, though it will be readily apparent that the overall number of slots 214 can be easily and suitably varied. In at least the illustrated embodiment, the front facing side 210 further includes a series of separate numeric or other demarcations 216 disposed in relation to each slot 214 that can provide a user with an indication of the horizontal dimension of the herein described reinforcement assembly 200, as further discussed in a subsequent portion. In addition, a similar and separately provided set of demarcations 216 can be provided and viewable from the rear facing side 212 of the horizontal extending portion 204, as shown in FIG. 3(*b*).

Still referring to FIGS. 3(*a*) and 3(*b*), the upper side 206 of the horizontal extending portion 211 includes a plurality of open-ended slots 220 disposed in spaced relation along an intermediate axial portion. These slots 220 extend inwardly from the rear facing side 212 toward the front facing side 210 and are defined by a substantially U-shaped configuration. As discussed herein, material portions of the rear facing side 212 directly beneath the slots 220 are removed to permit engagement by an intermediate linking member 240, FIG. 2, as discussed in a later part of this description. The upper side 206 of the horizontal extending portion 211 further includes at least one reinforcement supporting portion 227 that extends upwardly therefrom. According to this embodiment, the reinforcement supporting portion 227 is provided adjacent the corner brace 219 at the proximal end of the horizontal extending portion 204 and is configured to retain a portion of at least one reinforcement bar, such as rebar. It will be readily apparent that alternative positions for the reinforcement supporting portion 227 can be contemplated, depending on the application, size of the form and other factors. Specific details relating to the reinforcement supporting portion 227 are provided in a later portion of this description.

The vertically extending portion 215 of the first frame member 204 is defined by a substantially planar section having a plurality of spaced slots or recesses 224, 226 that are formed on each of the outer facing and inner facing sides thereof.

Figure 4A:
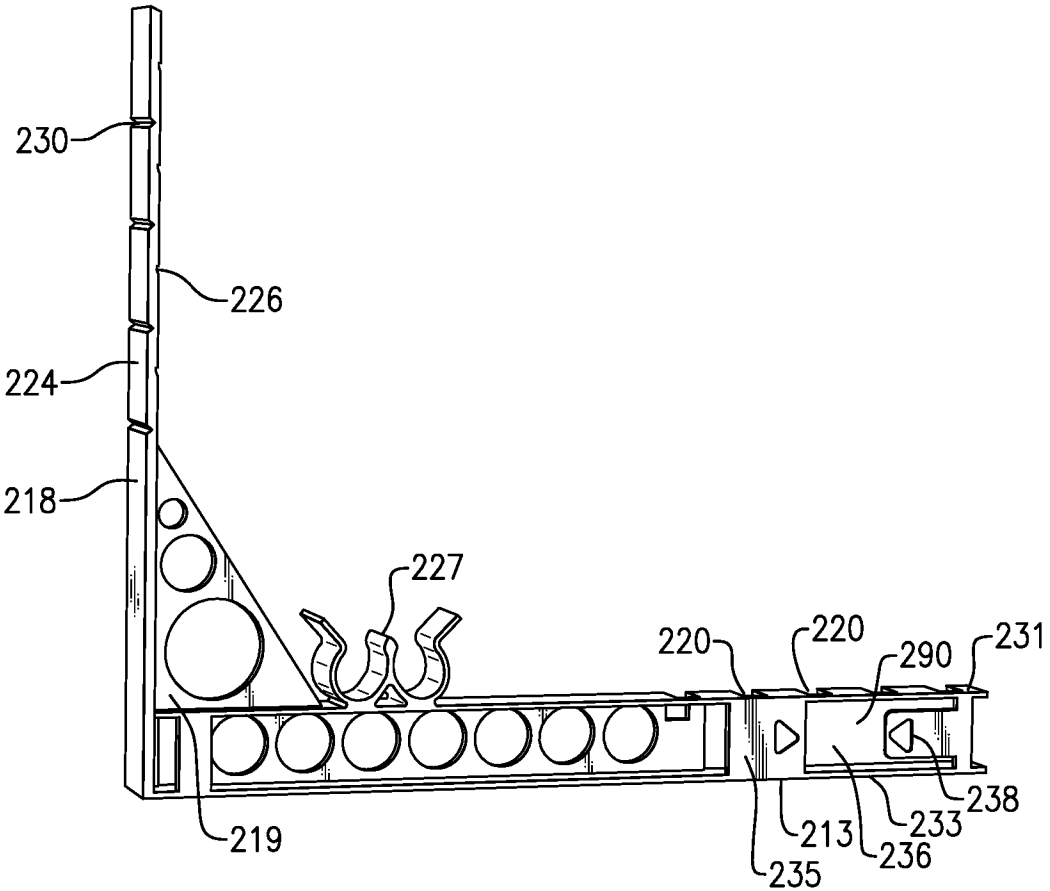
FIG. 4(*a*) is a front perspective view of a second frame member of the concrete reinforcement assembly of FIG. 2.
Figure 4B:
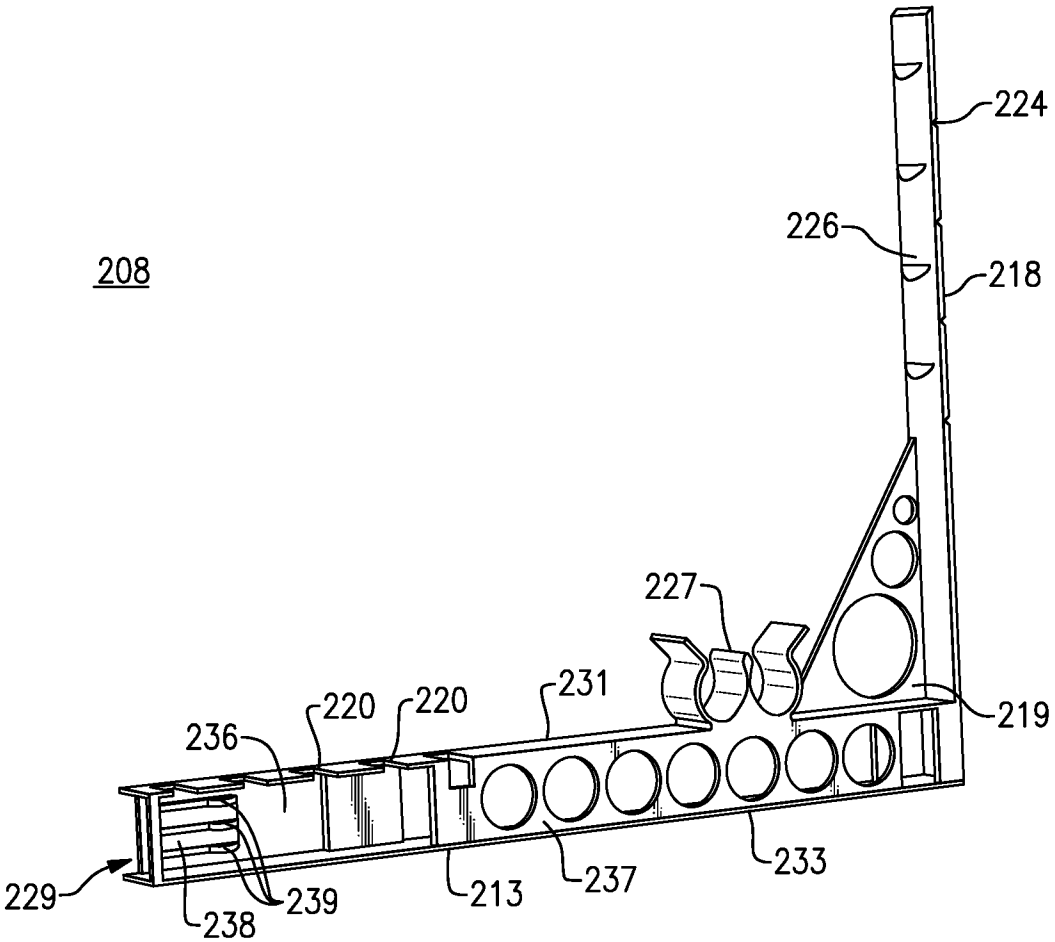

Referring to FIGS. 4(*a*) and 4(*b*), the second frame member 208 is defined similarly to the first frame member 204 and includes a horizontal extending portion 213, a vertical extending portion 218 and a corner brace 219, the latter feature being provided for structural integrity. In addition, the vertically extending portion 218 of the first frame member 208 is literally identical to that of the first frame member 204, FIG. 3(*a*), and defined by a substantially planar section having a plurality of spaced slots or recesses 224, 226 that are formed on each of the outer facing and inner facing sides thereof.

Unlike the first frame member 204, however, the horizontal extending portion 213 according to this exemplary embodiment is defined by an elongated cavity or enclosure 229 defining a hollow interior of the horizontal extending portion 215 extending over substantially the entire length thereof. The elongated cavity 229 is defined herein by a top wall 231, a bottom wall 233 and a pair of side walls, namely a front side wall 235 and a rear side wall 237, as designated herein for purposes of convention. The elongated cavity 229 is sized in terms of its interior dimensions and cross section to receive the horizontal extending portion 211 of the first frame member 204.

The top wall 231 of the second frame member 208 includes a reinforcement supporting portion 227 extending outwardly therefrom adjacent a proximal end of the horizontal extending portion 213. Details relating to the reinforcement supporting portion 227 are provided in a later portion of this application. Additionally, the top wall 231 includes a plurality of open-ended slots 220, identical to those provided on the first horizontal extending portion 211 of the first frame member 204 at a distal end thereof and similarly spaced from one another. The slots 220 extend from the rear side wall 237 toward the front side wall 235 and are defined by a substantially U-shaped configuration.

According to this specific embodiment, a majority of the material comprising the front side wall 235 and rear side wall 237, including material beneath the open-ended slots 220, is removed for purposes of removing excess weight and for embedment into the concrete form but an adequate amount of material is retained in order to maintain structural integrity. The front side wall 235 further includes an engagement member 238 disposed adjacent the distal end of the horizontal extending portion 213. The engagement member 238 is defined by a planar section cantilevered axially into a gapped area 236 of the front side wall 235 and having a tooth or series of teeth 239 disposed at a distal end. Referring specifically to FIG. 4(*b*), the teeth 239 of the engagement member 238 extend inwardly and partially into the elongated cavity 229 toward the rear side wall 237, and include a tapered engagement surface that is configured and shaped to selectively engage a vertical spaced slot 214, FIG. 3(*a*), of the extending horizontal section 211, FIG. 3(*a*), of the first frame member 204, FIG. 3(*a*), in order to provide horizontal adjustment capability. The tapered engagement surface is configured, according to this embodiment, such that the engagement surface can engage a slot 214 when moved in either axial direction relative to the elongated cavity 229.

Figure 5A:
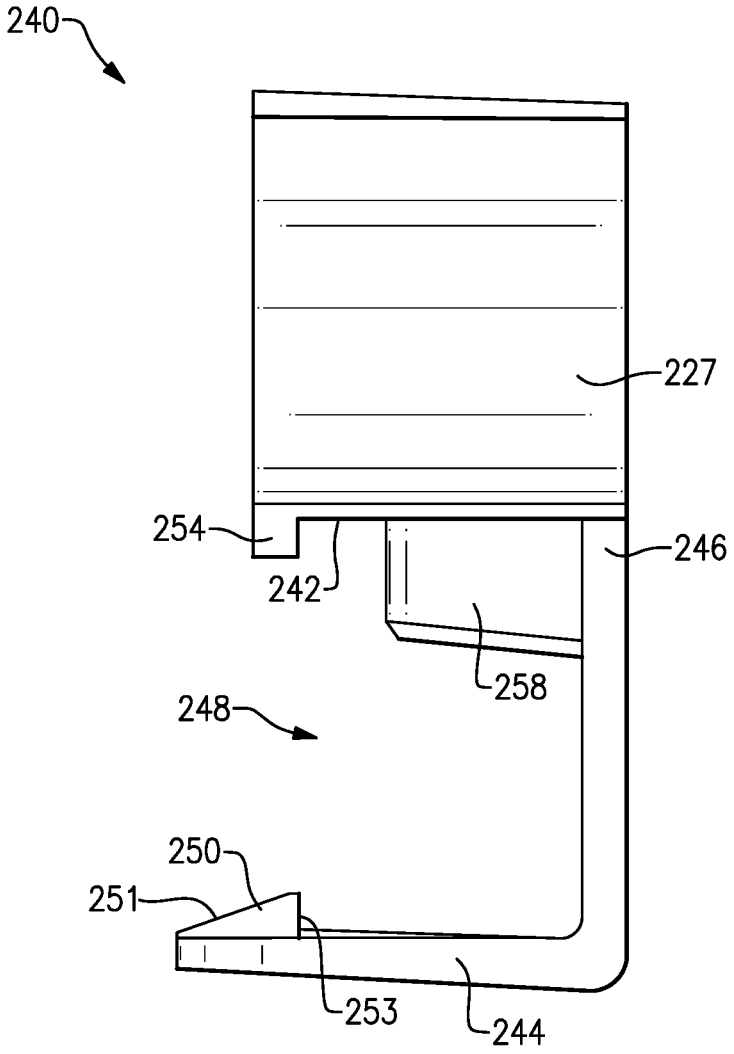
FIG. 5(*a*) is a side elevational view of an intermediary linking member used in the concrete reinforcement assembly of FIGS. 2-4.
Figure 5B:
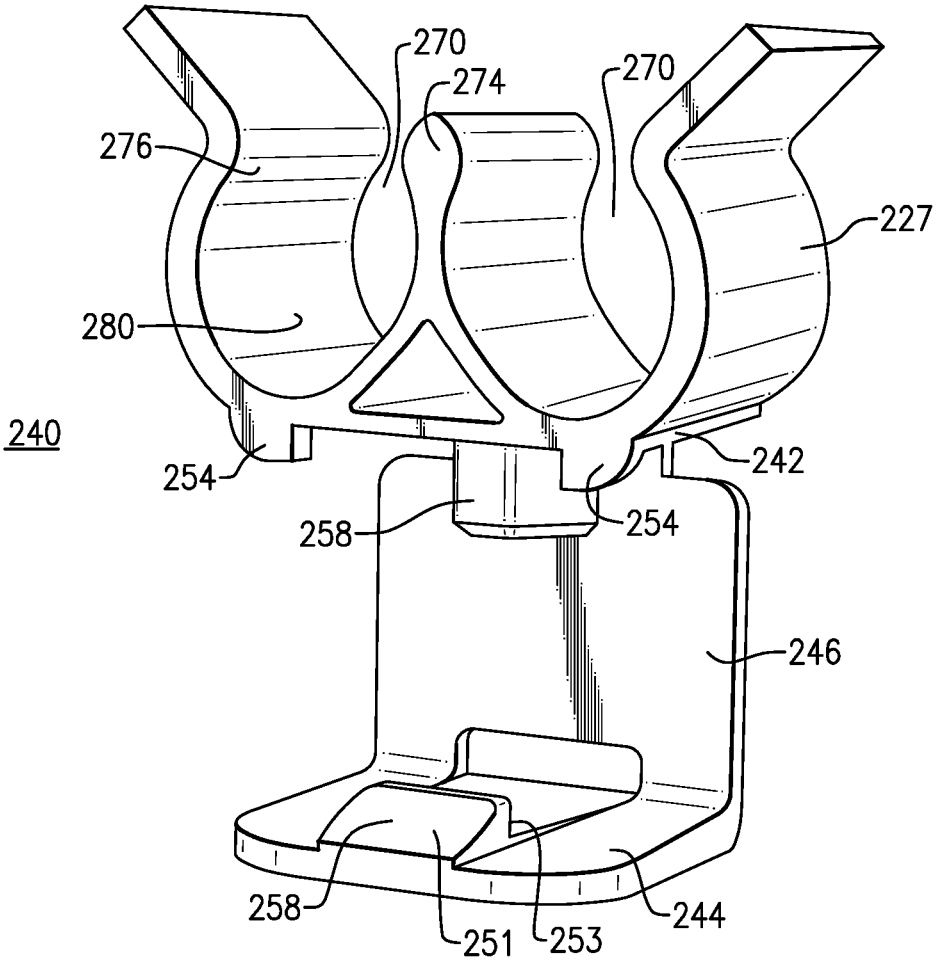

Referring to FIGS. 5(*a*) and 5(*b*) and according to this specific embodiment, the intermediary linking member 240 is defined by a unitary member, which is preferably made from a moldable plastic. It will be readily apparent, however, that any other suitable material can be used. More specifically and according to this specific embodiment, the intermediate linking member 240 is defined by opposing top and bottom sides 242 and 244 and a rear side 246. A predetermined gap 248 is established between the opposing top and bottom sides 242, 244, wherein the gap 248 is effectively sized between the top and bottom sides 242, 244 as well as between the front of the intermediary linking member 240 and the rear side 246. According to this embodiment, the bottom side 244 includes an engagement tab 250 defined by an angled distal surface 251 and a back surface 253. The engagement tab 250 is adjacent the front end of the linking member 240 that extends upwardly into the defined gap 248, while a pair of spaced interior tabs 254 at the front of the top side 242 extend downwardly into the defined gap 248. A rear protrusion 258 extends from the top and rear sides 242, 246 of the linking member 240 and into the defined gap 248.

As most clearly shown in FIG. 5(*b*), a reinforcement supporting portion 227 extends upwardly from the top side 242 of the intermediate linking member 240, this latter supporting portion 227 including a pair of open-ended receiving cavities 270 disposed in parallel relation and spanned by a common web 274. The intermediary linking member 240, including the rebar supporting portion 227, according to this embodiment is made from a flexible plastic material although it will be apparent that other suitable materials can be used. The open-ended receiving cavities 270 of the reinforcement supporting portion 227 are commonly defined by a narrowed entrance section 276 extending to a substantially circular receiving part 280, the latter being made from a flexible material to permit various sizes of reinforcement members, such as linear sections of rebar (not shown) to be fitted through the narrowed entrance section 276, which is deformed elastically to permit the reinforcement (not shown) to be retained within an open-ended receiving cavity 270.

For purposes of this embodiment and following attachment of the horizontal extending portion 211 of the first frame member 204 into the elongated cavity 229 of the second frame member 208, the rear protrusion 258 of the herein described linking member 240 is sized to engage one of the open-ended spaced slots 220 formed on each top surface of the mated horizontal extending portions 211, 213 of the first and second frame members 204, 208. The spacing between the engagement tab 250 and the inner surface of the rear side 246 enables the fitting of the intermediate linking member 240 between the horizontal extending portions 211, 213 of the first and second frame members 204, 208.

Figure 6A:
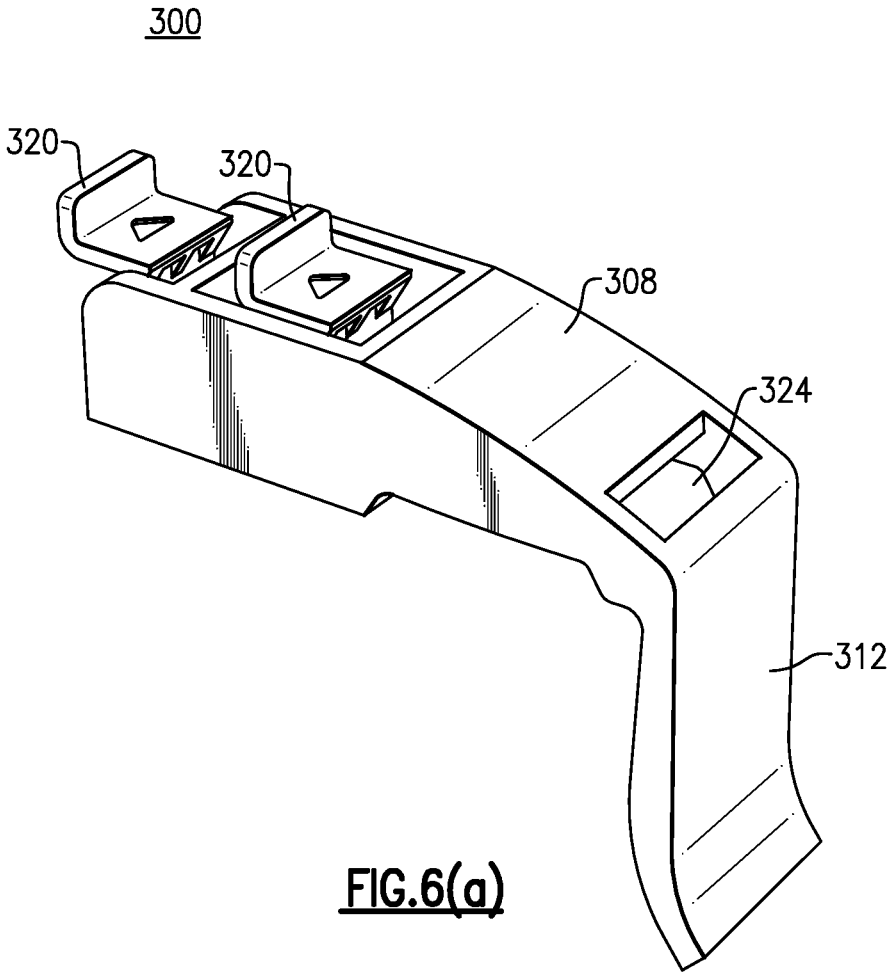
FIG. 6(*a*) is a front perspective view of a hanger member used in the concrete reinforcement assembly of FIGS. 2-5.
Figure 6B:
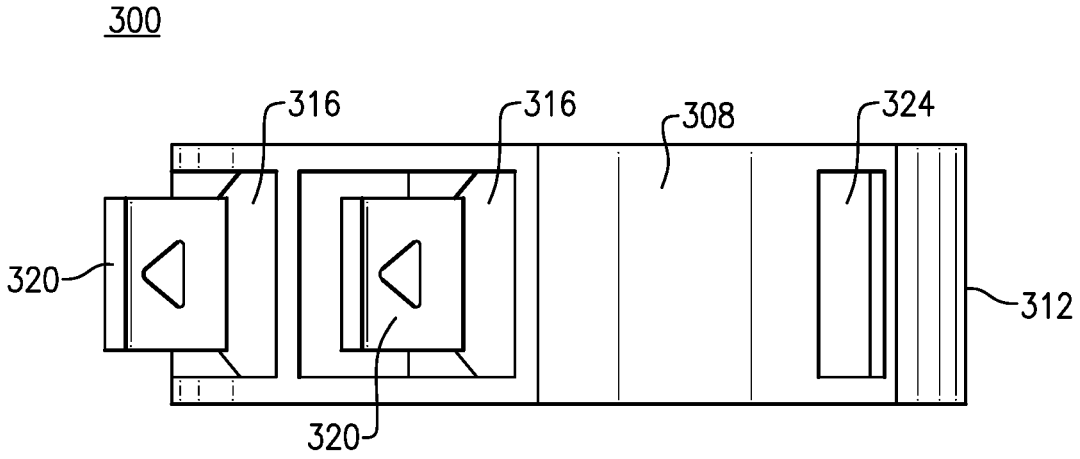

Referring to FIGS. 6(*a*) and 6(*b*), one of the hanger members 300 is shown in perspective and in plan view, respectively. The remaining hanger member 300 is identical in terms of function and structure according to this exemplary embodiment and therefore description effectively covers both hanger portions 300. More specifically, the hanger member 300 is defined by a molded plastic body having a transverse upper or top portion 308 and a downwardly extending portion 312 at an outer end, wherein the hanger member 300 is defined by a substantially reverse L-shaped configuration. At least one opening 316 is provided in the transverse upper portion 308 proximate an inner end. According to this embodiment, a pair of spaced openings 316 are provided in parallel relation adjacent the inner end, each opening 316 being sized for receiving the vertical extending portion 215, 218, FIG. 7, of the first and second frame members 204, 208, FIG. 7. A flexible engagement member 320 is provided that extends inwardly toward each opening 316. When assembled and according to this exemplary embodiment, an inverted C-shaped cap is defined by the vertically extending portion 215, 218 and the transverse upper portion 308 and downwardly depending portion 312 of the hanger portion 300, which is sized to fit over and depend from the top part of a form, such as a wall (not shown) wherein the width spanning the vertically extending portion 215, 218 of the frame member 204, 208 and the downwardly depending portion 312 of the hanger member 300 can be selectively changed. An additional opening 324 is provided at the top of the downwardly extending portion 312 that is configured for receipt of a hammer claw or other tool that facilitates breakage of the hanger portion 300 from the assembly in the disassembly/breakdown of the form (not shown) following use.

Figure 7:
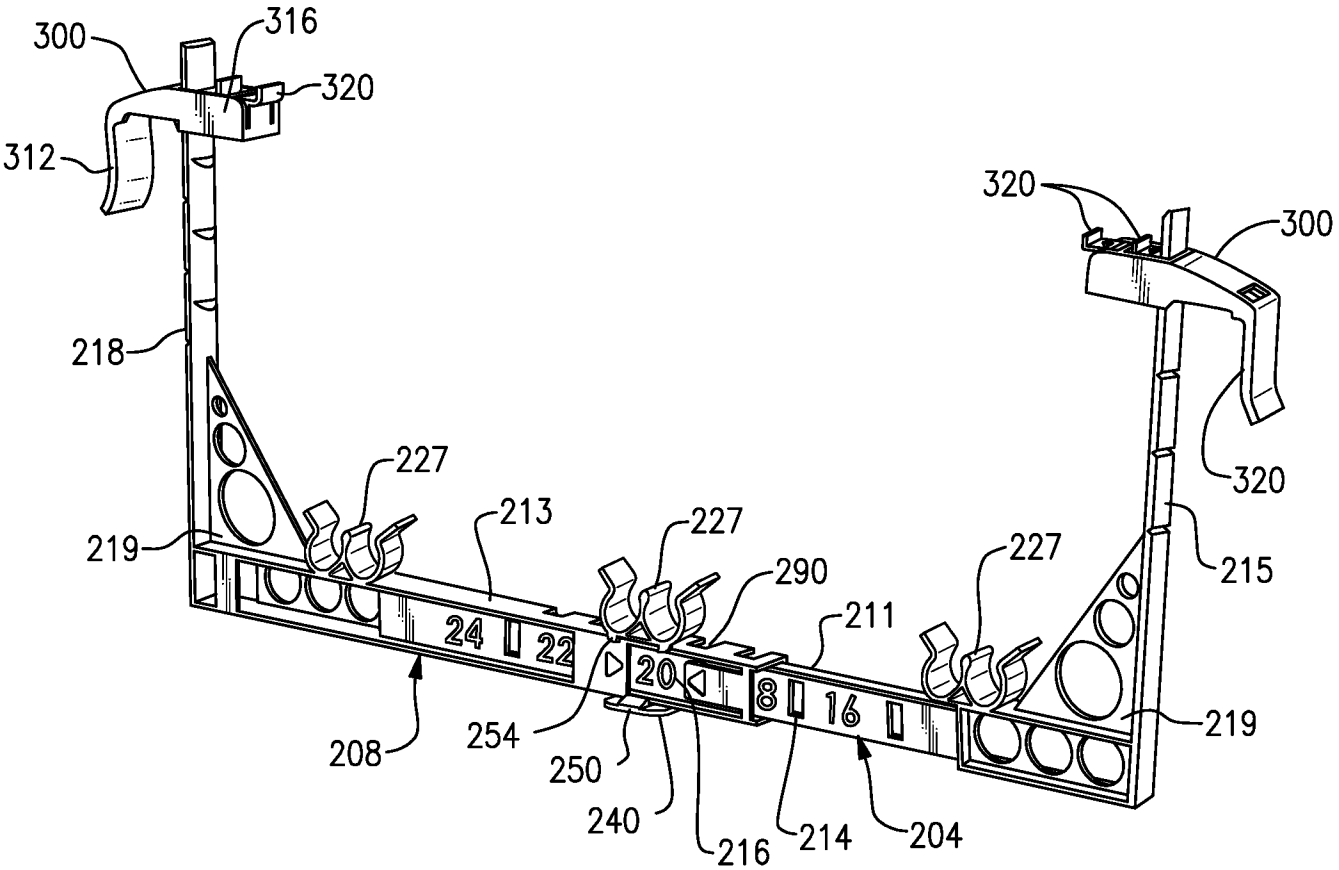
FIG. 7 is a perspective view of the concrete reinforcement assembly of FIGS. 2-6 in an assembled form.

Referring to FIG. 7 and for purposes of assembly, the horizontal extending portions 211, 213 of the first and second frame members 204, 208 are mated with one another. More specifically, the horizontal extending portion 211 of the first frame member 204 is fitted within the elongated cavity 229 of the second frame member 208. In passing, it will be readily apparent that the elongated cavity can alternatively be provided on the horizontal extending portion of the first frame member 204 with the fitted part of the horizontal extending portion being provided on the second frame member 208. In addition and though the horizontal extending portion 211 and the elongated cavity 229 are defined with a substantially rectangularly-shaped cross section according to this embodiment, it will be readily apparent that other suitable polygonal shapes could also be contemplated for use.

For purposes of selecting an appropriate horizontal dimension of the assembly 200 (depending on the span of the footing), the horizontal extending portion 211 is axially advanced into or retracted from the elongated cavity 229 with the demarcations 216 being presented to the user. According to this embodiment, a window 290 provided on the front facing side 235 of the horizontal extending portion 213 is aligned with the demarcations 216 such that a predetermined demarcation (e.g., 20) is present in the window 290 and indicative of the present horizontal dimension or form designator. Assuming this is the proper horizontal dimension, the assembly 200 is configured such that visualization of the demarcation 216 places one of the axially spaced vertical slots 214 in proximity to the flexible engagement member 238. Axial movement engages the teeth 239 of the flexible engagement member 238 with one of the axially spaced vertical slots 214. Once this horizontal position has been established, the intermediate linking member 240 can be then be attached to the assembly 200.

According to this embodiment as shown in FIGS. 2-5(*b*) and FIG. 7, a single intermediate linking member 240 is aligned with one of the open-ended slots 220 provided on the top surface of the frame members 204, 208 at an intermediate portion of the assembly 200. Preferably and according to this embodiment, a slot 220, disposed directly above the engagement member 238 is selected to receive the linking member 240. To attach the intermediary linking member 240 to the assembly 200, the top and bottom sides 242, 244 of the linking member 240 are placed over the mated top and bottom walls 231, 233 with the rear protrusion 258 being aligned with the open end of the slot 220. As the intermediate linking member 240 is drawn toward the front of the assembly 200, the top and bottom sides are deformed elastically about the mated frame members 204, 208 wherein the angled distal surface 251 of the engagement tab 250 of the bottom surface is caused to move across the exterior of the bottom surface 233 and engage the front side wall 235 and the interior tabs 254 are similarly caused to overlap the top surface 231 and also engage the front side wall 235 of the assembly 200. The gap 248 is sized such that the intermediate linking member 240 provides a clamping force upon the engaged horizontal extending portions 211, 213 so as to effectively maintain the assembly 200 in the selected horizontal orientation.

With reference to FIGS. 6(*a*), 6(*b*), and FIG. 7, the hanger members 300 are adjustably movable along the span of the vertically extending portions 215, 218 using one of the defined openings 316. The flexible engagement member 320 includes an extending feature that inwardly engages one of the slots 224 on the inner side of a vertically extending portion 215, 218 to retain the hanger member 300. Pulling the extending end of the flexible engagement member 320 toward the inner end of the assembly 200 enables the hanger member 300 to be repositioned vertically or removed.

For purposes of adjusting the span of the hanger member 300, a user can select either of the parallel openings 316, providing additional versatility to the assembly 200. As shown in FIG. 7, the opening 316 closest to the outer end of the hanger member 300 (e.g., toward the downwardly extending portion 312) is shown. To increase the distance between the vertically extending portions 215, 218 of the frame and the downwardly extending portion 312, the remaining opening 316 is selected and passed through the vertically extending portion 215, 218. As a result, the distance measured between the vertically extending portions 215, 218 and the downwardly extending portion 312 of the hanger member 300 can be selectively adjusted to enable the reinforcement assembly 200 to be used with a varied number of differently sized concrete forms.

Figure 13:
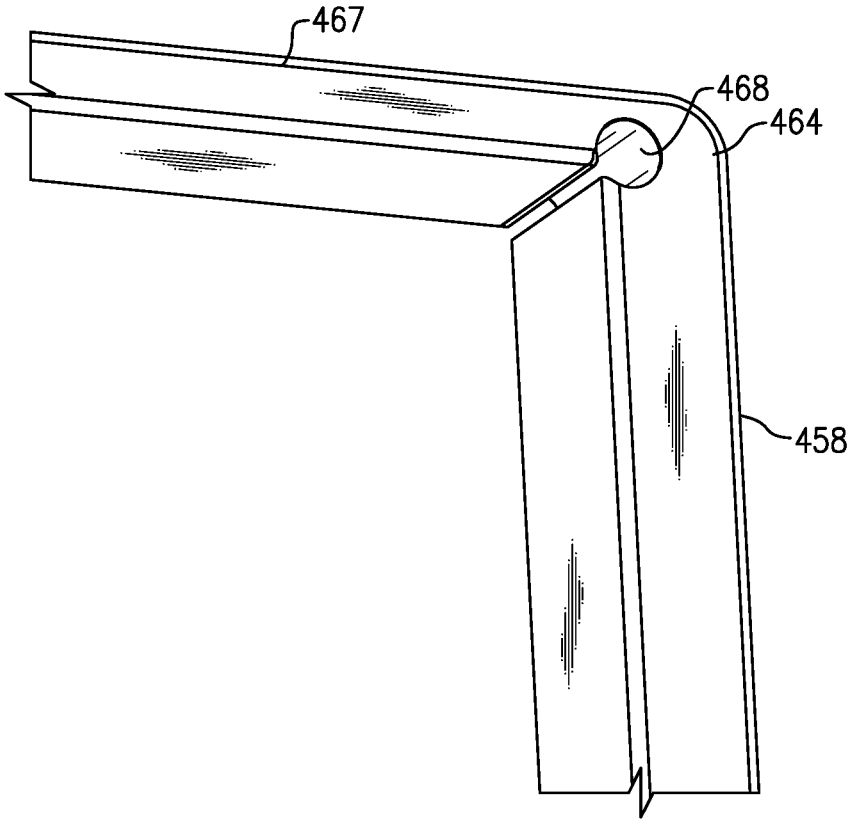
FIG. 13 is an enlarged view of a version of a corner portion of the frame member of FIGS. 11 and 12 that facilitates breakdown following use.

After the concrete has been poured, the assembly 200 can be broken away from the form (not shown) using a hammer or other suitable tool by engaging the opening 324 to remove the hanger members 300 from the top of the wall of the form and the slots 224, 226 of the vertically extending portions 215, 218 to permit breakdown of the form. In an alternative version, shown in FIG. 13, an integral hanger member includes a portion 467 cantilevered from the upper end of the vertically extending portion 458 of a frame member. In this version, a weakened area 468 is disposed at the corner 464, permitting break away of the assembly when the hanger member is acted upon with a hammer or similar tool (not shown).

It will be understood that various modifications can be made to this design. For example, a concrete reinforcement assembly in accordance with a second embodiment is shown in FIGS. 8-12. The reinforcement assembly 400 is shown in an unassembled condition in FIG. 8 and is defined by a base member 404 and a pair of frame members 450. Details of the components of the reinforcement assembly 400 will now be described in greater detail.

Figure 9:
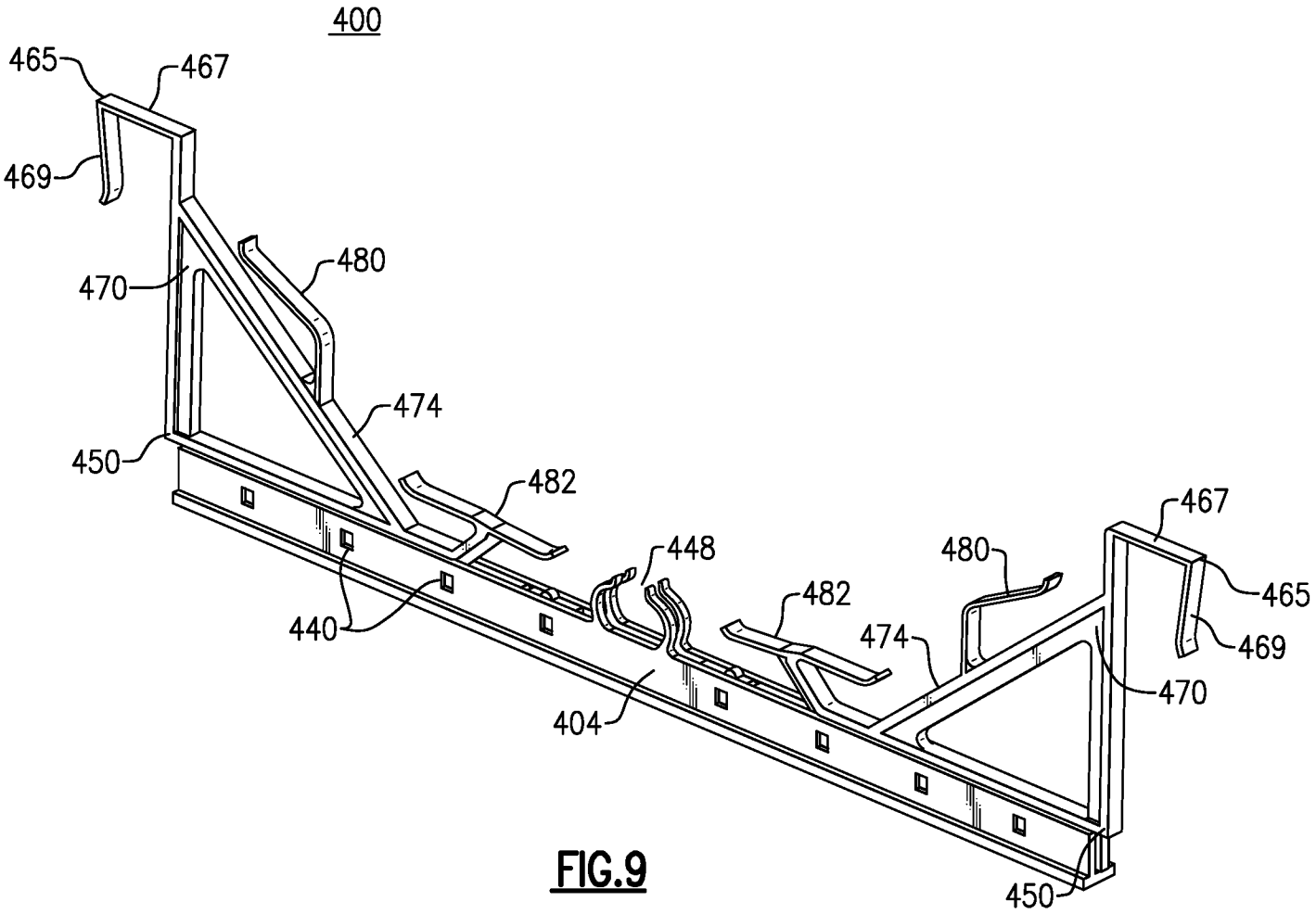
FIG. 9 is a front perspective view of the concrete reinforcement assembly of FIG. 8, as assembled.
Figure 10:
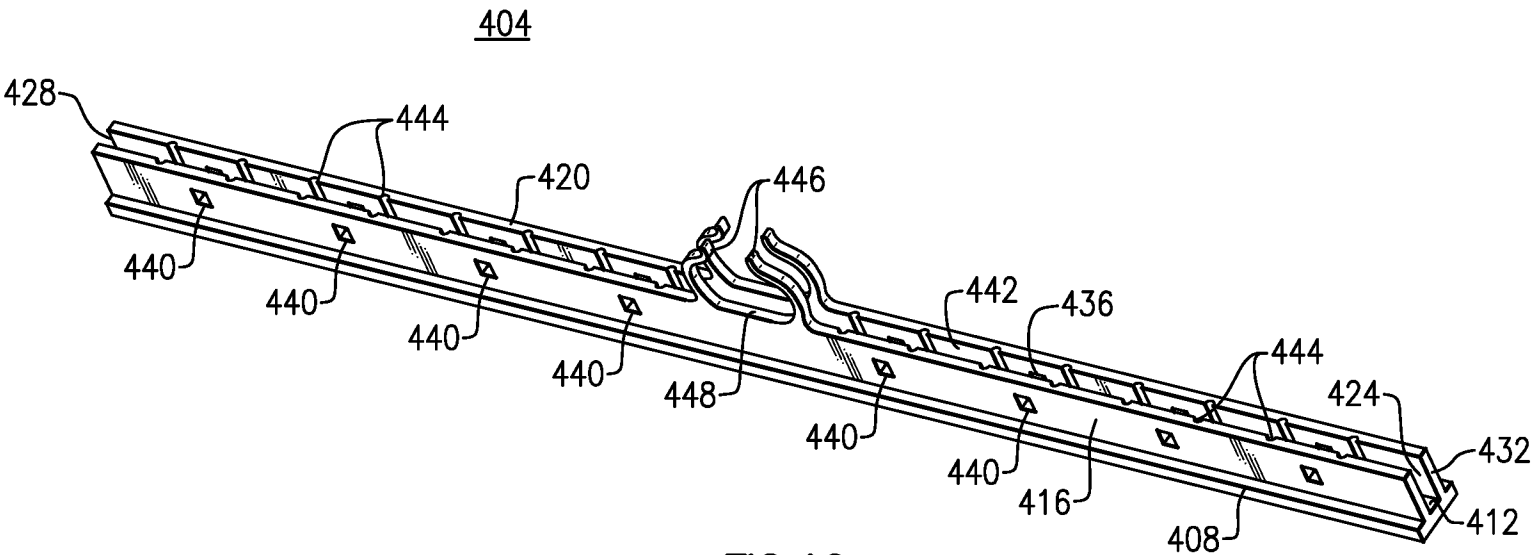
FIG. 10 is a top perspective view of a base member of the concrete reinforcement assembly of FIGS. 8 and 9.

With reference to FIGS. 9 and 10, the base member 404 according to this embodiment is defined by a lower portion 408 having a planar support surface 412 and a pair of parallel walls, namely a front wall 416 and a rear wall 420 in spaced relation with one another with each of the walls 416, 420 projecting upwardly from the planar support surface 412. A space 424 formed between the front and rear walls 416, 420 defines a rectilinear cavity 436 extending to respective ends 428, 432 over the entire axial length of the base member 404. Each of the front and rear walls 416, 420 further include a plurality of spaced openings 440. According to this embodiment, the spaced openings 440 are defined by a predetermined spacing of about two (2) inches, but the number as well as the relative spacing of the openings 440 can be suitably varied along the length of the base member 404.

The interior surface 442 of each of the front and rear walls 416, 420 further include a plurality of vertically extending notches 444, also disposed in spaced relation with each other. According to this specific embodiment, a vertically extending notch 444 is positioned on adjacent sides of each of the spaced openings 440 with the notches 444 being spaced from one another in spaced intervals. In the embodiment shown, the spacing for each interval is about one (1) inch, but it will be understood that this parameter can easily be varied, depending on the concrete form configuration. More specifically, a total of four (4) openings 440 and a total of eight (8) vertically extending notches 444 are evenly spaced along the length of the base member 406 on each side of the base member 406 relative to the center of the span. As noted, it will be understood that the number and relative spacing of the openings and notches can be suitably varied.

Still referring to FIGS. 9 and 10, the upper surface of each of the front and rear walls 416 and 420 includes a pair of flexible vertically extending arms 446 at the center of the base member 406. The arms 446 are disposed in spaced parallel relation to one another and combine to define a reinforcement support 448, whose function is described below in greater detail.

With reference to FIGS. 8, 9, 11 and 12, each of the frame members 450 are commonly defined by a horizontal extending section 454 and a vertical extending section 458 forming a substantial L-shape with the vertical extending section 458 projecting upwardly from one end of the horizontal extending section 454. The exterior front and rear surfaces of the horizontal extending section 454 of each frame member 450 include a plurality of locking tabs 462 that are disposed in spaced relation and preferably in the same spaced relation as the openings 440 of the base member 404. In addition, a plurality of spaced vertical protrusions 466 are also provided on the exterior front and rear surfaces of each horizontal extending portion 454. The plurality of vertical protrusions 466 are sized and spaced in the same manner as the plurality of vertically extending notches 444 formed on the interior surface 442 of the front and rear walls 416, 420 of the base member 404.

Figure 11:
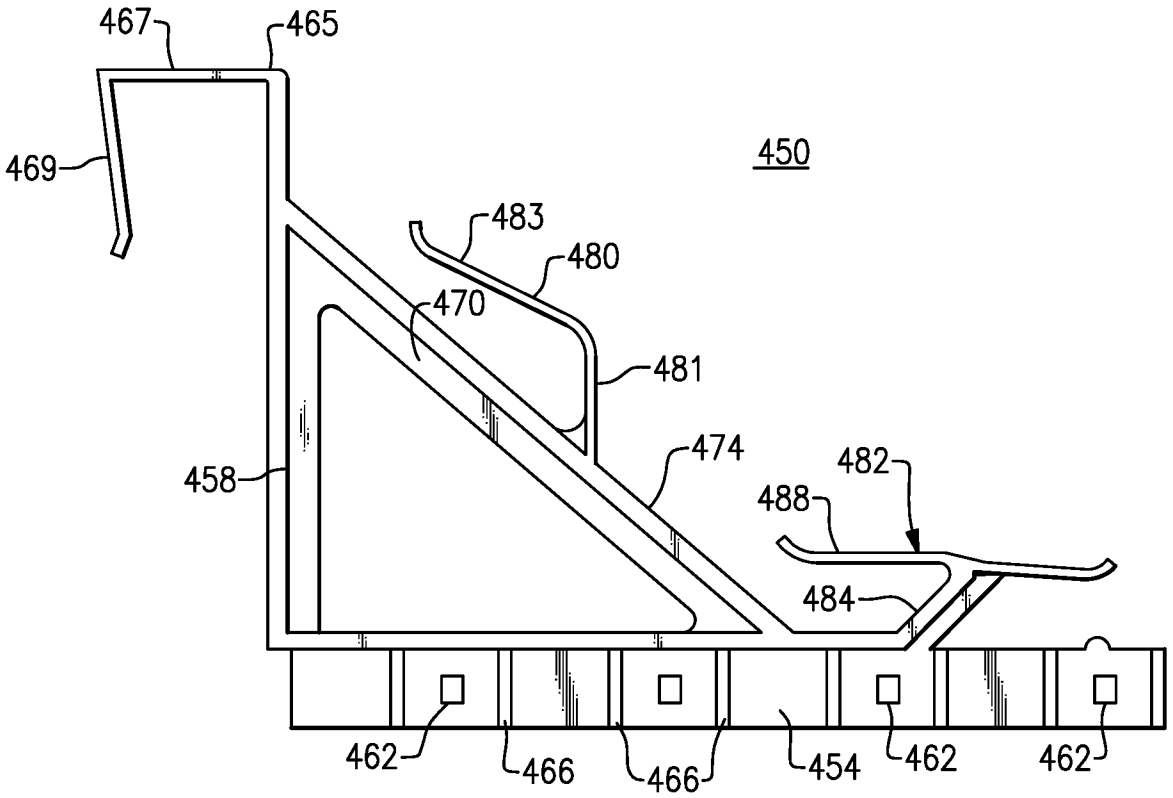
FIG. 11 is a side elevational view of a frame member of the concrete reinforcement assembly of FIGS. 8-10.

With reference to FIGS. 9 and 11, the vertical extending portions 458 of each frame member 450 includes a hanger member 465. According to this embodiment, the hanger member 465 is defined by a cantilevered portion 467 that extends from the uppermost end of the vertically extending portion 458 oppositely and parallel to the horizontal extending portion 454 of the frame member 450. The hanger member 465 is further defined by a downwardly depending section 469 formed at the extending end of the cantilevered portion 467, the downwardly extending section 469 being slightly reflexed toward the vertical extending portion 458. The cantilevered portion 467 and the downwardly depending portion 469 are sized and configured to engage an upper wall (not shown) of the concrete form (not shown).

According to this specific embodiment, a corner brace 470 is integrally disposed between the horizontal extending portion 454 and the vertically extending section 458 of each frame member 450. According to this embodiment, the corner brace 470 is defined by an angled surface 474 in which at least one concrete reinforcement support 480 is disposed on an exterior facing side of the angled surface 474. Reinforcement supports 482 are further provided on an upper surface of the horizontal extending portion 454 of each of the frame members 450, in addition to the reinforcement support 448 provided at the center of the base member 404.

In this specific embodiment and with reference to FIGS. 9 and 11, the reinforcement supports 480 are each commonly defined by a leg 481 extending substantially vertical in relation to the angled surface 474. An upper extending portion 483 is cantilevered from the upper end of the leg 481 and extends parallel or preferably slightly reflexed toward the angled surface 474. This arrangement defines a receiving cavity defined on respective sides by the angled surface 474, the leg 481 and the upper extending portion 483, respectively, the cavity being shaped and sized to receive a section of rebar or other reinforcement member (not shown).

Figure 12:
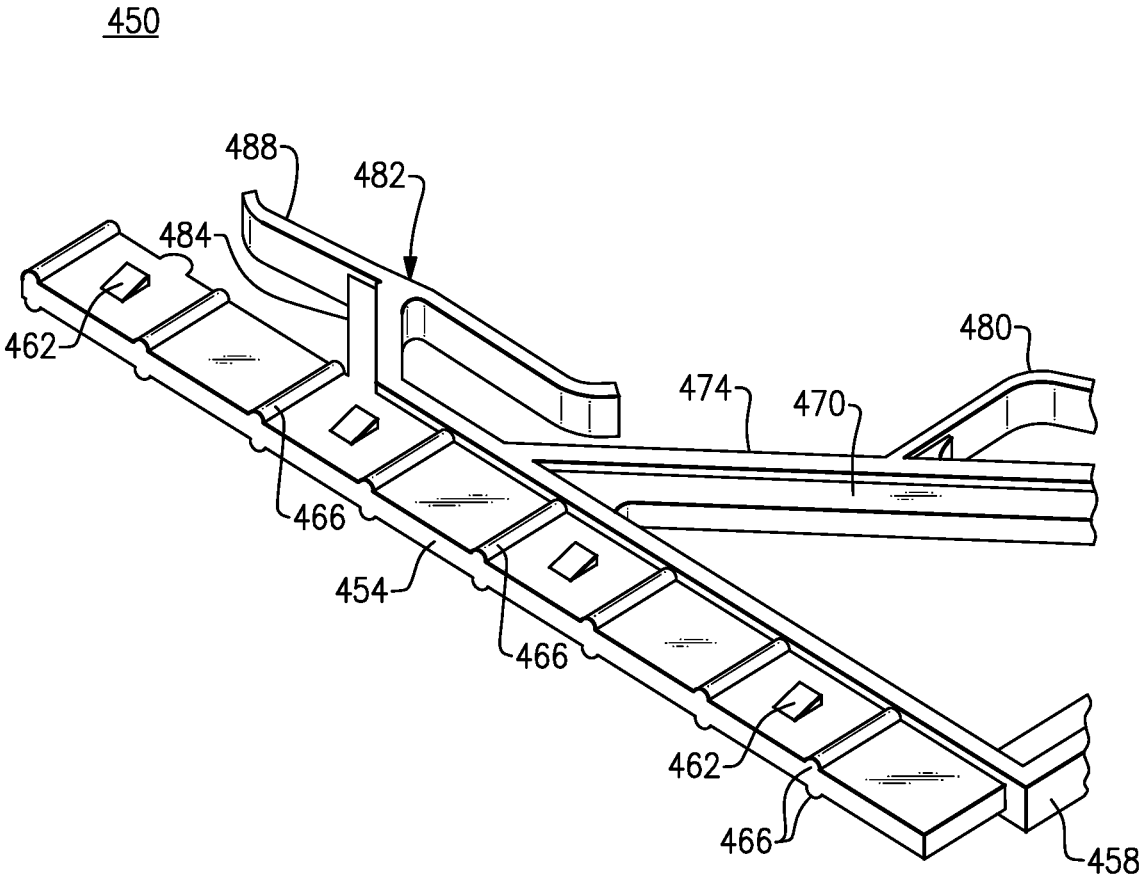
FIG. 12 is a partial side perspective view of the frame member of FIG. 11.

With reference to FIGS. 9, 11 and 12, the reinforcement supports 482 are commonly defined by a leg 484 projecting from the upper surface of the horizontal extending portion 454, as well as a substantially planar support surface 488, the supports 482 defining an open-ended cavity that enables placement of a rebar or similar reinforcement member. It will be readily apparent that the size and shape of each of the reinforcing supports 448, 480, 482 can be suitably varied.

Figure 8:
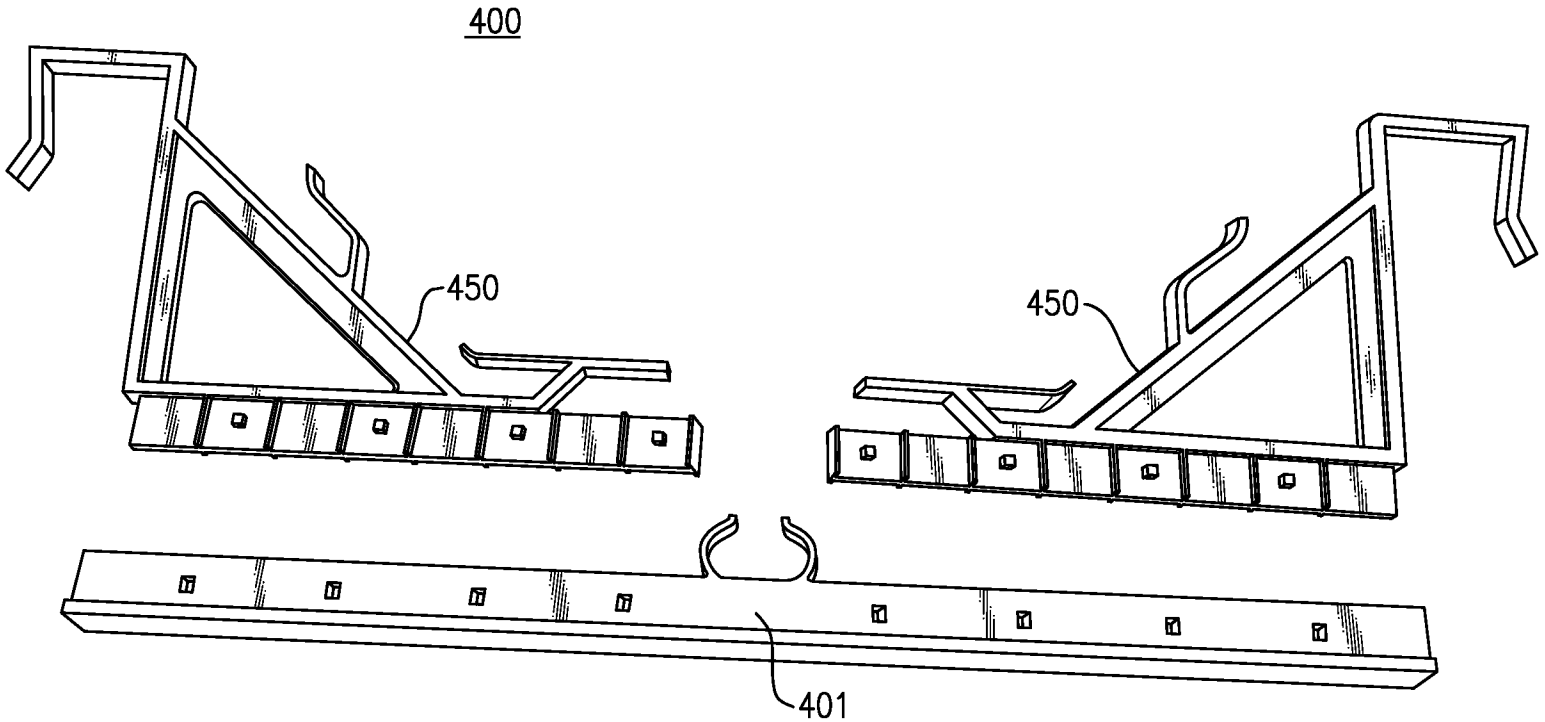
FIG. 8 is an exploded assembly view of a concrete reinforcement assembly made in accordance with a second embodiment.

With reference to FIGS. 8, 9 and 11 and when assembled, each of the frame members 450 and more specifically the horizontal extending portion 454 is engaged with the defined axial cavity 436 of the base member 404, with the vertical extending portion 458 of each frame member 450 being disposed on opposite ends of the assembly 400. The spaced openings 440 of the base member 404 are sized to receive the locking tabs 462 provided on the front and rear exterior surfaces of each of the pair of frame members 450, while the notches 444 receive the vertical protrusions 466. Accordingly, the horizontal dimension or width of the assembly 400 can be selectively adjusted to fit a plurality of differently sized concrete forms (not shown). The horizontal extending portion 454 of each frame member 450 can therefore extend outwardly from the respective ends 428, 432, FIG. 9, of the base member 404 in which the length of the assembly 400 can be adjusted between a minimum horizontal dimension and a maximum horizontal dimension. According to one version, the horizontal dimension of the assembly 400 can be varied between 20 inches and 28 inches. According to another version, the horizontal dimension can be varied between 30 inches and 40 inches. Other suitable ranges can be contemplated.

The vertically extending portion 458 is orthogonal to the horizontal extending portion 454, wherein an upper end of the vertically extending section 458 includes the C-shaped hanger member 465 configured to engage with, by fitting over an upper portion of a wall (not shown) of a concrete form (not shown). It should be noted that the height of the vertically extending sections 458 can be suitably varied to accommodate literally any footing depth.

In operation, the herein described concrete reinforcement assembly 400 can be used as follows. First, the lower end of the two frame members 450 and more specifically the horizontal extending portions 454 of each frame member 450 are engaged within the defined rectilinear cavity 436 of the base member 404. In this configuration, the horizontal position of the frame members 450 can be varied by movement of the horizontal extending portions 454 of the frame members 450 within the defined cavity 436. The engagement between the locking tabs 462 and the openings 440 formed in the side walls 416, 420 of the base member 404 causes engagement and fixes the relative position of the frame members 450 within the defined cavity 436. This adjustment permits each of the hanger portions 465 to be placed over the top wall of the concrete form (not shown).

Once set in the concrete form (not shown), a plurality of the herein described reinforcement assemblies 400 can be positioned depending on the size (width/height) of the form in parallel and spaced relation to one another. The reinforcement supports of each aligned assembly 400 permit the placement of rebar or other reinforcement elements within the form relative to any of the reinforcement supports 448, 480, 482.

As previously noted and once the concrete has been poured, the herein described assembly 400 can be removed using a hammer or similar tool. For example, the corner 464 bridging the cantilevered portion 467 of the hanger member and the upper end of the vertically extending portion 458 can optionally include a weakened area 468.

PARTS LIST FOR FIGS. 1-13

100 concrete reinforcement assembly
103 horizontal portion
104 singular section
107 hanger portions
108 opposing ends
114 reinforcement retainer portions
200 concrete reinforcement assembly
204 first frame member
206 upper side, first frame member
208 second frame member
209 lower side, first frame member
210 front facing side
211 horizontal extending portion, first frame member
212 rear facing side
213 horizontal extending portion, second frame member
214 axially spaced vertical slots
215 vertical extending portion, first frame member
216 demarcations, series
217 rear facing side or surface, horizontal extending portion, first frame member
218 vertical extending portion, second frame member
219 brace, corner
220 slots, open-ended
224 slots or recesses
226 slots or recesses
227 reinforcement supporting portion
229 elongated cavity or enclosure
231 top wall
233 bottom wall
235 side wall (front)
236 gapped area
237 side wall (rear)
238 flexible engagement member
239 teeth
240 intermediary linking member
242 top side, linking member
244 bottom side, linking member
246 rear side
248 gap
250 engagement tab
251 angled distal surface
253 back surface, tab
254 interior tabs
258 rear protrusion
270 receiving cavities, open ended
274 web
276 narrowed entrance portion
280 substantially circular receiving port
290 window
300 adjustable hanger members
308 transverse upper or top portion
312 downwardly extending portion
316 openings, spaced
320 engagement member, flexible
324 opening
400 concrete reinforcement hanger assembly
404 base member
408 lower section
412 planar support surface
416 front wall
420 rear wall
424 space
428 end, base member
432 end, base member
436 rectilinear cavity
440 openings, spaced
442 interior surface, walls
444 notches, vertical
446 vertically extending flexible arms
448 center reinforcement support
450 frame members
454 horizontal extending portion
458 vertical extending portion

462 locking tabs
464 corner
465 hanger members
466 vertical protrusions
467 cantilevered portion
468 weakened portion
469 downwardly depending section
470 corner brace
474 angled surface
480 reinforcement support
481 leg
482 reinforcement supports
483 upper extending portion
484 leg
488 planar support surface It will be readily apparent that other modifications and variations are possible within the intended scope of this invention, and according to the following claims.

The invention claimed is:

1. An adjustable concrete reinforcement assembly comprising:

a base member having a front wall, a rear wall and a rectilinear cavity formed between the front wall and the rear wall, said rectilinear cavity extending over an entire length of the base member, the base member including opposing open ends;

a first frame member and a second frame member, each of the first and frame members including a horizontal portion and an integral vertical portion in which the horizontal portion of each of the first and second frame members is disposed within the rectilinear cavity of the base member, said rectilinear cavity being defined by three open sides, including an open top and the opposing open ends of the base member; and a hanger member at an upper end of the vertical portions of each of the first and second frame members, the hanger member being sized and configured to engage a top portion of a concrete form, wherein each of the first and second frame members are axially movable within the rectilinear cavity of the base member to enable a horizontal dimension of the reinforcement assembly to be selectively adjustable such that the horizontal portions of each of the first and second frame members are fully disposed within the rectilinear cavity of the base member to define a minimum horizontal dimension of the reinforcement assembly and wherein a portion of the horizontal portions of each of the first and second frame members are configured to move outwardly from the opposing open ends of the base member to adjustably define one or more additional horizontal dimensions of the assembly.

2. The adjustable concrete reinforcement assembly according to claim 1, in which the base member and the horizontal portions of the first and second frame members include a plurality of axially spaced engagement features to enable the reinforcement assembly to assume a plurality of predetermined horizontal positions and in which one of the horizontal portions of the first and second frame members or the base member include a plurality of axially spaced locking tabs and the other of the horizontal portions of the first and second frame members or the base member include a plurality of axially spaced openings sized to receive a said locking tab.

3. The adjustable concrete reinforcement assembly according to claim 2, in which one of the horizontal portions of the first and second frame member or the base member include a plurality of axially spaced vertical protrusions and the other of the horizontal portions of the first and second frame members or the base member include a plurality of axially spaced notches sized to engage any of the vertical protrusions to define the plurality of predetermined horizontal positions.

4. A method of assembling and using the adjustable concrete reinforcement assembly of claim 2, said method comprising:

providing the base member, including the rectilinear cavity formed between the front and rear walls of the base member;

fitting the horizontal portions of each of the first and second frame members fully within the rectilinear cavity of the base member to define the minimum horizontal dimension of the assembly; and selectively adjusting the engagement features of the base member and first and second frame members to provide predetermined horizontal dimensions based on outward movement of the first and second frame members from the open ends of the base member within the formed rectilinear cavity.

5. The method according to claim 4, further comprising engaging the hanger member of the first and second frame members onto the top of a concrete form.

6. The method according to claim 5, further comprising engaging at least one section of rebar with at least one reinforcement support of the adjustable concrete reinforcement assembly.

7. The adjustable concrete reinforcement assembly according to claim 1, in which at least one of the base member or the first and second frame members include at least one reinforcement support, the at least one reinforcement support being configured to support a section of rebar.

8. The adjustable concrete reinforcement assembly according to claim 7, in which the first and second frame members include a corner brace having an angled surface disposed between the vertically portion and horizontal portion.

9. The adjustable concrete reinforcement assembly according to claim 8, wherein the first and second frame members are defined by an L-shaped configuration.

10. The adjustable concrete reinforcement assembly according to claim 8, in which the at least one reinforcement support is disposed on the corner brace of the first and second frame members.

11. The adjustable concrete reinforcement assembly according to claim 8, in which the at least one reinforcement support is disposed at approximately the center of the length of the base member.

12. The adjustable concrete reinforcement assembly according to claim 11, in which the at least one reinforcement support is disposed on an upper surface of each of the first and second frame members and between a corner brace of the first and second frame members and the reinforcement support at the center of the length of the base member.

13. The adjustable assembly according to claim 1, wherein at least one of the base member and the first and second frame members include a series of spaced demarcations.

14. The adjustable assembly according to claim 1, wherein each hanger member includes an upper transverse portion and a downwardly depending portion sized and configured to engage the top of a concrete form.

* * * * *